United States Patent [19]

Yang

[11] Patent Number: 4,688,505

[45] Date of Patent: Aug. 25, 1987

[54] SEA-SHIPPING SYSTEM HAVING SERIAL FLOAT BALL-SHAPED VEHICLES WITH FLUID OR POWDERED OR PELLET OBJECTS

[76] Inventor: Tai-Her Yang, 5-1 Taipin St., Si-Hu Town, Dzan-Hwa, Taiwan

[21] Appl. No.: 791,593

[22] Filed: Oct. 25, 1985

[51] Int. Cl.[4] ..... B63B 25/08

[52] U.S. Cl. ..... 114/72; 114/256; 114/73; 114/249

[58] Field of Search ..... 114/74 R, 74 T, 256, 114/257, 253, 249, 26, 267, 242, 77 R, 73, 74 A

[56] References Cited

U.S. PATENT DOCUMENTS

| | | | |
|---|---|---|---|
| 1,201,051 | 10/1916 | Jack | 114/257 |
| 2,370,679 | 3/1945 | Martinelli et al. | 114/249 |
| 3,482,541 | 12/1969 | Kanbe | 114/256 |
| 3,974,789 | 8/1976 | de Groot | 114/74 T |
| 4,438,719 | 3/1984 | Finsterwalder | 114/74 R |

FOREIGN PATENT DOCUMENTS

| | | | |
|---|---|---|---|
| 3230781 | 2/1984 | Fed. Rep. of Germany | 114/74 R |
| 173496 | 11/1960 | Sweden | 114/74 R |

*Primary Examiner*—Joseph F. Peters, Jr.
*Assistant Examiner*—Edwin L. Swinehart
*Attorney, Agent, or Firm*—Leonard Bloom

[57] ABSTRACT

A sea-shipping system includes one or more substantially spherical vessels which may be towed behind a water going vehicle. The vessels are submergible for storage purposes.

4 Claims, 5 Drawing Figures

SEA-SHIPPING SYSTEM HAVING SERIAL FLOAT BALL-SHAPED VEHICLES WITH FLUID OR POWDERED OR PELLET OBJECTS

FIELD OF THE INVENTION

The present device relates to shipping containers, and, in particular, to floating shipping vessels for shipping fluid, powdered or pelletized objects.

BACKGROUND OF THE INVENTION

This invention is a device and method for replacing conventional huge fluid carrying ships. In the present invention a water borne vehicle draws a series of ball-shaped vessels carrying the fluid. This reduces the required draft depth and also avoids the large-scale pollution resulting from disasters. This invention helps unify inland, international and intercoastal shipping.

SUMMARY OF THE INVENTION

For a long time, the transport of fluid objects (such as crude oil) has been carried by huge vessels. Generally, a crude oil exporter pumps the crude oil to a tanker at the harbor. It is then transported over long distances to a port from where the crude oil is put into a storage tank. Economic considerations tend to require a vessel inside a vehicle with a long hull and deep draft. The related inland transport loading and unloading are very inconvenient. When a disaster takes place, pollution is formed on the sea surface. The main object of design in the present invention is that a plurality of ball-shaped vessels are used to contain fluid. They have a cover and a ballast. They are mutually joined and hooked in series, then a water borne vehicle may draw them and travel over the ocean, or inland waterway.

BRIEF DESCRIPTION OF THE DRAWINGS

FIGS. 1-1, 1-2, & 1-3 show a view of the tri-dimensional vessels in various geometric shapes.

FIG. 1-4 is a view of an example of the submersible vessel having an anchor for submerged storage.

DETAILED DESCRIPTION OF THE INVENTION

The usual shipping unit constitutes a large carrier. Large ships are still used for the transport of fluids. The way of using huge ships for carrying crude oil is often by way of 200,000 ton-plus class vessels with deep drafts. When a sea disaster takes place, the entire ship load of crude oil is lost. This causes a big financial loss and also results in sea surface pollution. Therefore the design of the present invention is aimed at improving the above-said defects.

Figure 1:
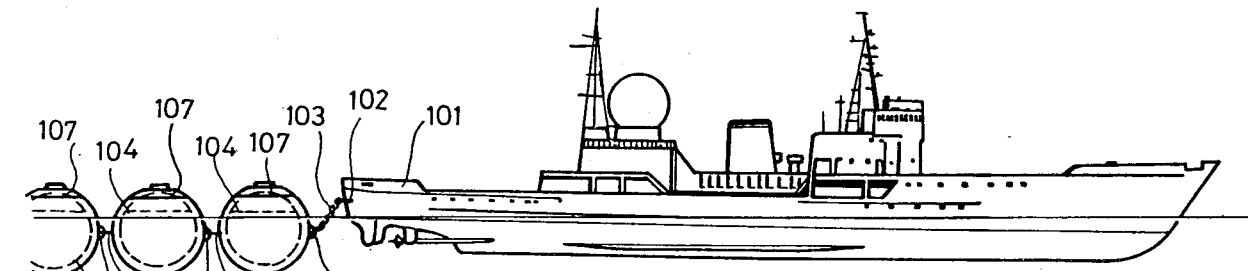
FIG. 1 is a view of the formation of the sea shipping system having serial floating ball-shaped vessels.

The system and structure of the design in this invention are described as follows:

As shown in FIG. 1, a vehicle 101 having motive power, has a tow device 102 on the stern to join the ball-shaped vessels 104 to the tug.

Figures 1, 2:
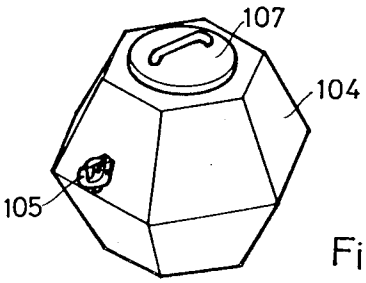
Figure 1:
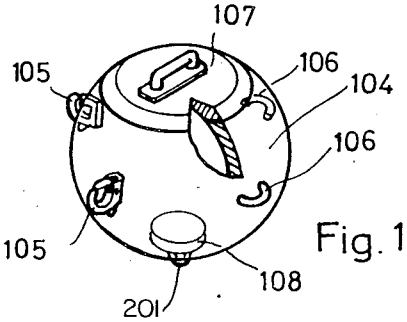
Figures 1, 2, 3:
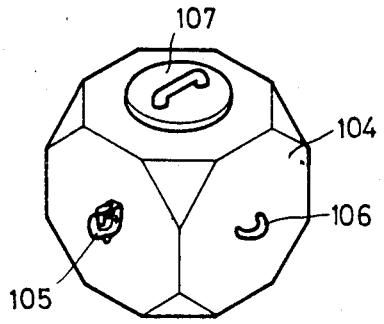
Figures 1, 2, 3, 4:
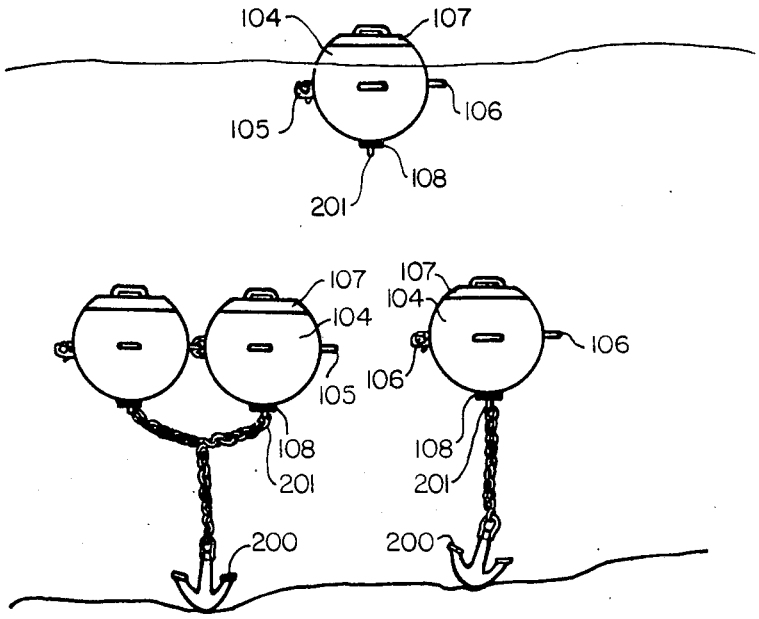

The ball-shaped vessels (body portion) 104 may be a tri-dimensional hexahedron or spheroid or other proper solid geometrical shapes as shown in FIGS. 1-1, 1-2 and 1-3. the upper portion of said body portion being truncated having a substantially planar wall extending thereacross. An opening is formed in this planar wall. At least two hang hooks 105 and connection "eye" devices 106 are provided. Vessels are attached by linking hooks to eyes. The hatch and cover 107 are provided to load the vessels and to seal them off. the hatch means for covering the opening further covers substantially all of the truncated upper portion. A ballast 108, having a through hole 201 is provided to stablize the vessels and to hang on the anchors 200 as shown in FIG. 1-4. the ballast is so provided being positioned diametrically to the opening In other words the above-said system uses the vehicle 101 to tow the ball-shaped vessel groups loaded with a fluid or powdered or pellet objects. After the cover 107 is closed, the vessel can float on the water surface. The ball-shaped vessel groups are mutually tracted in series towed to the transport destination.

The sea shipping system has the following merits:

1. A shallower draft: since this sytem is in a form of separate ball-shaped vessels, the draft is shallower.
2. Convenient loading and unloading: the ball-shaped vessels can be disengaged, transferred, and then towed into the port by smaller vehicle.
3. Convenient inland transport: as each of the ball-shaped vessels has a systematic standard structure, a standardized transportation for them may be designed (such as container tractors) for easy transportation.
4. Low costs: the vehicle port of this system is shifted away from land storage tanks, so the system cost approaches the cost of the vessel.
5. Very convenient emergency storage and general storage: for instance, in crude oil loading and transport, one may hang submersible anchors from the vessels so they may be set on the seabed. This replaces the large scale on-land oil storage tank.
6. To limit the disaster scale: in the wreck of an oil tanker, generally an entire ship load gets lost, thus causing serious pollution on the sea. Although some tankers have partitioned oil tanks to limit the oil loss during a disaster, after a tanker is sunk, it is very difficult to draw and store the crude oil. In this system, the separate serial ball-shaped loading and carrying can limit the disaster scale and facilitate lost oil recovery.
7. Separate line operations during shipping: generally, all the oil tankers carry a single ship load of crude oil to one destination, for example, from Abadan to Kaohsiung port. If it is desired to discharge a partial shipment of crude oil at Singapore, the tanker has to make a detour to and call Hong Kong port to pump out such a load. This detour not only takes much time but also increases the voyage mileage and thus the costs. Using the instant invention, some of the ball-shaped vessels can be discharged at Singapore which by the ship going to Hong Kong, thereby lowering the transport costs.
8. The present invention can be used in inland transport from oil fields, eliminating the need for oil pipelines leading to the coast. This type of ball-shaped vessels can even save crude oil storage costs by serving as a storage container.

Summing all the above up, the novelty of the sea shipping system of the serial ball-shaped vessels is apparent and its practicability can be affirmed.

I claim:

1. A container for storing and shipping a liquid or a solid, wherein the container is adapted to be towed by a vessel, comprising, in combination:

a spherically-shaped body portion, the upper portion of said body portion being truncated and having a substantially planar wall extending thereacross, said planar wall having an opening formed therein, whereby internal access to the container is provided for the filling and emptying thereof;

a ballast integral with the container being diametrically positioned to the opening;

a hatch means for covering and sealing the opening; and means for removably coupling said container to adjacent containers, whereby simultaneous towing of a plurality of such containers is facilitated.

2. The container of claim 1, wherein the hatch means for covering the opening further covers substantially all of the truncated upper portion.

3. The container of claim 1, wherein the means for removably coupling said container to adjacent containers being comprised of:

at least one eyelet being suitably secured to the body portion of the container; and at least one hook means being suitably secured to the body portion of the container for cooperating engagement with the eyelet of an adjacent container, whereby said containers may be removably coupled for the simultaneous shipment thereof.

4. A container for storing and shipping a liquid or a solid, wherein the container is adapted to be towed by a vessel, comprising, in combination:

a spherically-shaped body portion, the upper portion of said body portion being truncated and having a substantially planar wall extending thereacross, said planar wall having an opening formed therein, whereby internal access to the container is provided for the filling and emptying thereof;

a ballast integral with the container being diametrically positioned to the opening;

a hatch means for covering and sealing the opening, wherein when said hatch means seals the opening, said hatch means covers substantially all of the truncated upper portion;

at least one eyelet being suitably secured to the body portion of the container; and at least one hook means, being suitably secured to the body portion of the container for cooperating engagement with the eyelet of an adjacent container, whereby said containers may be removably coupled for the simultaneous shipment thereof.

* * * * *